US008550653B2

(12) United States Patent
Wilson et al.

(10) Patent No.: US 8,550,653 B2
(45) Date of Patent: Oct. 8, 2013

(54) LED FLARE

(75) Inventors: Troy Wilson, Minden, NV (US); Chuan Zhong He, Shenzhen (CH)

(73) Assignee: Aervoe Industries, Inc., Gardnerville, NV (US)

( * ) Notice: Subject to any disclaimer, the term of this patent is extended or adjusted under 35 U.S.C. 154(b) by 229 days.

(21) Appl. No.: 13/105,994

(22) Filed: May 12, 2011

(65) Prior Publication Data

US 2012/0287611 A1 Nov. 15, 2012

(51) Int. Cl.
*F21L 4/00* (2006.01)

(52) U.S. Cl.
USPC ..... 362/183; 362/157; 362/184

(58) Field of Classification Search
USPC ..... 362/183, 157
See application file for complete search history.

(56) References Cited

U.S. PATENT DOCUMENTS

| | | | | |
|---|---|---|---|---|
| 4,282,562 | A | 8/1981 | Marino | |
| 4,926,300 | A * | 5/1990 | Ralston | 362/189 |
| 5,081,568 | A | 1/1992 | Dong et al. | |
| 6,486,797 | B1 | 11/2002 | Laidman | |
| D515,958 | S | 2/2006 | Dueker | |
| 7,088,222 | B1 | 8/2006 | Dueker | |
| 7,261,456 | B2 | 8/2007 | Liu | |
| D560,533 | S | 1/2008 | Dueker et al. | |
| 7,784,204 | B2 * | 8/2010 | Staats et al. | 40/546 |
| 8,147,087 | B2 * | 4/2012 | Chen | 362/184 |
| 2002/0180616 | A1 | 12/2002 | Laidman | |
| 2002/0191396 | A1 | 12/2002 | Reiff | |
| 2004/0130886 | A1 * | 7/2004 | Lewis et al. | 362/101 |
| 2004/0145890 | A1 | 7/2004 | Liao | |
| 2007/0121332 | A1 | 5/2007 | Kuo-Hsin | |
| 2007/0176784 | A1 | 8/2007 | Fautin | |
| 2008/0036584 | A1 | 2/2008 | Lang | |
| 2011/0096534 | A1 * | 4/2011 | Lee | 362/133 |

* cited by examiner

*Primary Examiner* — Evan Dzierzynski

(57) ABSTRACT

A LED flare and system for use at night, in low light conditions or during the day where a lighted object provides greater visibility. The flare comprises a multi-sided housing with a panel on each side and having a top and a base. It has a plurality of LEDs aligned in windows positioned in at least one of the panels. A switch located on the housing operates the flare. The flare also includes a re-chargeable battery encased in the housing for powering the flare and a circuit for delivering power and operational control from the battery to the LEDs upon activation by the switch. A set of contacts positioned on the outside of the housing deliver a charge to the battery. The flare includes an attachment device for holding an external charger in place against the contacts during charging operation. An individual flare may be part of a system that also includes other flares and a carrying case with an integrated charger and charger accessories.

24 Claims, 12 Drawing Sheets

LED FLARE

CROSS-REFERENCE TO RELATED APPLICATIONS

The present Application is related to each of the following commonly-owned, co-pending U.S. Patent Applications: 1) design application Ser. No. 29/387,692, filed Mar. 16, 2011, entitled "LED Flare," and now issued as U.S. Pat. No. D650, 932; 2) Ser. No. 13/049,761, filed Mar. 16, 2011, entitled "LED Flare;" and 3) design application Ser. No. 29/391,694, filed May 12, 2011, entitled "LED Flare;" now issued as U.S. Pat. No. D654,387. The entirety of each of these related Applications above is incorporated by reference in the present Application.

BACKGROUND

Battery powered LED flares are used by police, fire, airport workers, construction crews, emergency personnel and others to provide warning signals of all kinds at night, in low light conditions or even during the day where a lighted object provides greater visibility.

These types of devices are limited by the number and configuration of LEDs that are incorporated in them. It is desirable to increase the distance at which the warning signals can be seen. Additionally, devices of this type may not be durable to withstand harsh treatment such as being dropped on the ground or operating in inclement conditions such as very cold temperatures, rain, sleet or snow. Another shortcoming is that they are battery operated and require maintaining a backup set of batteries in the event that the batteries fail. In cases where the devices use rechargeable batteries, they must be removed from the unit and placed in a separate charger.

SPECIFICATIONS

Detailed Description

Figure 1A:
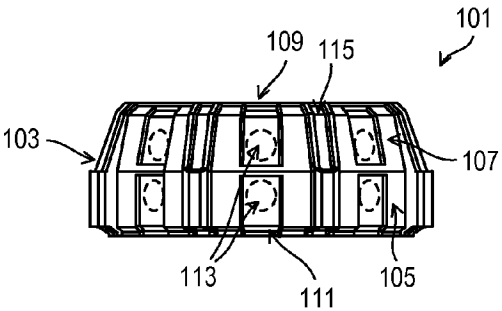
FIGS. 1A-1F show a variety of views of a LED flare in a first embodiment.

The present invention will now be described more fully with reference to the accompanying drawings. It should be understood that the invention may be embodied in many different forms and should not be construed as limited to the embodiments set forth herein. Throughout FIGS. 1-8, like elements of the invention are referred to by the same reference numerals for consistency purposes.

FIGS. 1A-1F show a variety of views of a LED flare 101. As can be seen in FIG. 1A, LED flare 101 has a body that is multi-sided. In FIG. 1A, LED flare is octagonal, but it may be formed with any number of sides around the periphery. In the embodiment shown, periphery or side 103 is made up of 8 pairs of stacked panels. In each pair, there is a lower panel 105 and an upper panel 107. Upper panel 107 is angled inwardly towards a top 109 of flare 101 while lower panel 105 is at approximately a right angle with a bottom 111 of flare 101. A window 113 is formed in each upper panel 107 and in each lower panel 105. A protective casing 115 or shield made of rubber, plastic or silicone is formed in a top component 115*a* (see FIG. 3) and a bottom component 115*b* (see FIG. 3) over the body of flare 101 to cushion the internal components of flare 101 in the event that flare 101 is dropped, hit or otherwise subjected to harsh conditions. Cut-outs in protective casing 115 are aligned with windows 113 so that light emitted through windows 113 is not blocked by protective casing 115. A hanger 117 is integrated into protective shield 115 through which a string, wire or carabiner can be passed to allow LED flare 101 to be hung from a hook or other rod-shaped device. A switch 118 is mounted in top 109 to turn LED flare 101 on and off as well as perform other operational functions.

Figure 1C:
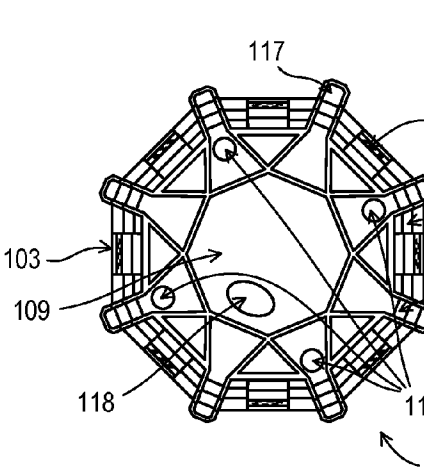
Figure 1B:
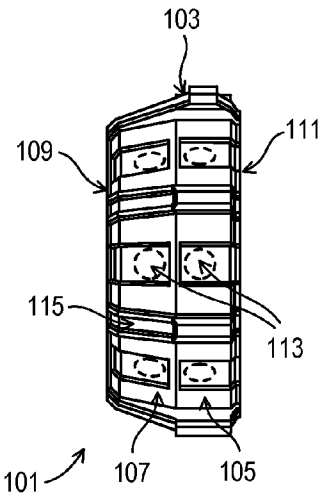
Figure 1D:
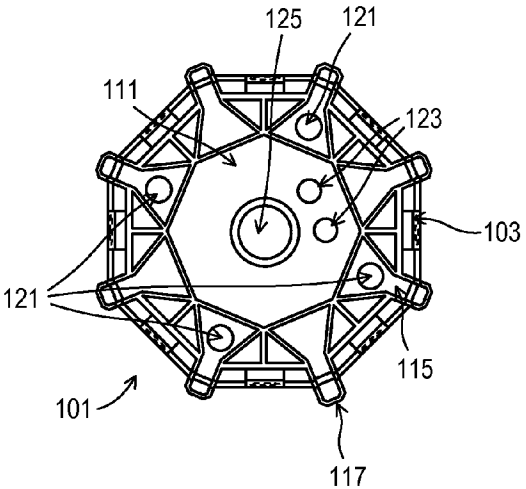

Both top 109 and bottom 111 of LED flare 101 are substantially flat on one side as can be seen in a top up view of LED flare 101 shown in FIG. 1C and a bottom up view of LED flare 101 shown in FIG. 1D. Backs 121 in the form of nuts or other similar holding components in combination with binding posts 119 which may be screws rivets or other attachment pins hold top 109 and bottom 111 of LED flare 101 together while a pair of charging posts 123 are used to connect a charger that recharges one or more re-chargeable batteries housed inside of the body of LED flare 101. Attachment device 125 is preferably a magnet so that it can be easily and quickly attached, removed and re-attached to magnetic objects such as the side of vehicle or a metal sign without damaging the object to which it is attached. As an alternative, attachment device 125 may be one side of Velcro® type hook and loop fasteners or a reusable sticky material.

Figure 1F:
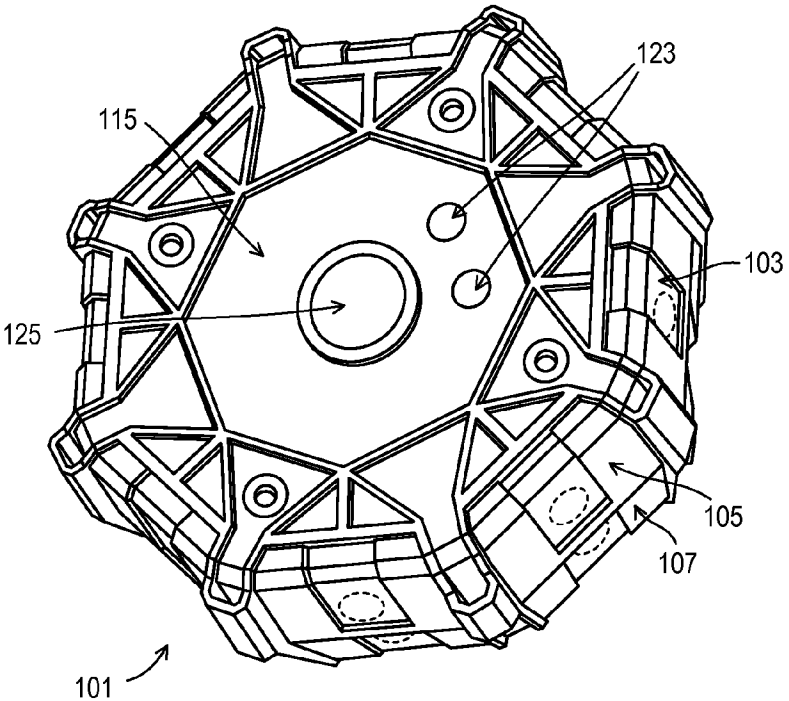
Figure 1E:
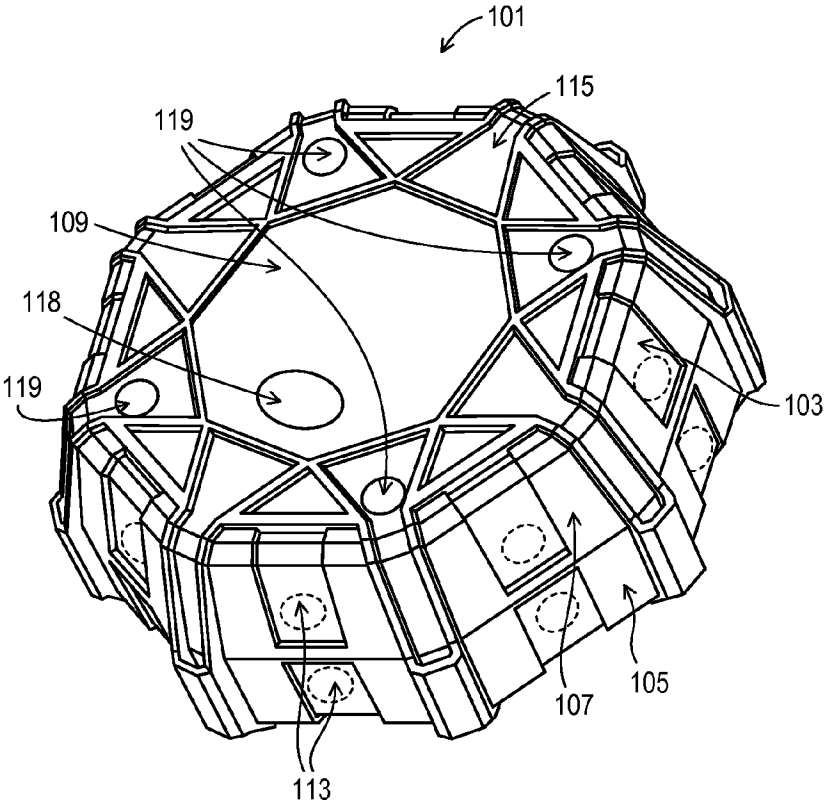
Figure 2A:
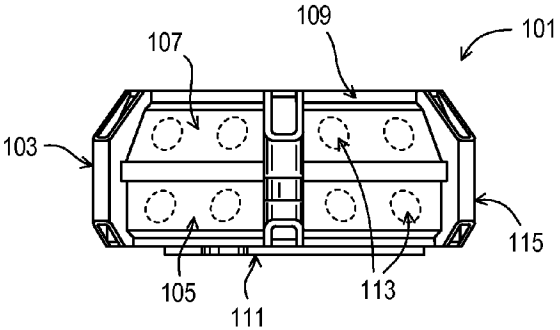
FIG. 2A-F show views of a LED flare in a second embodiment
Figure 2B:
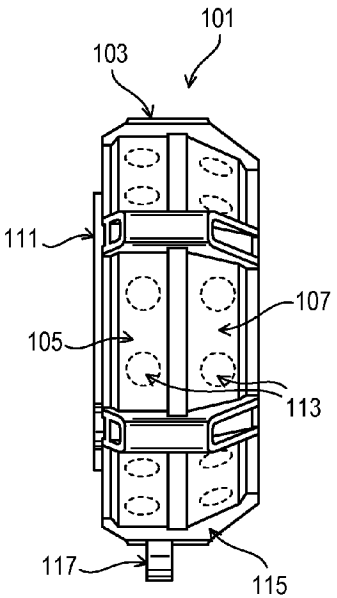
Figure 2C:
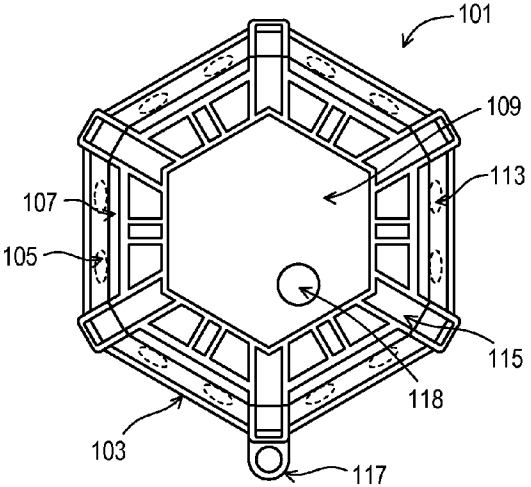
Figure 2D:
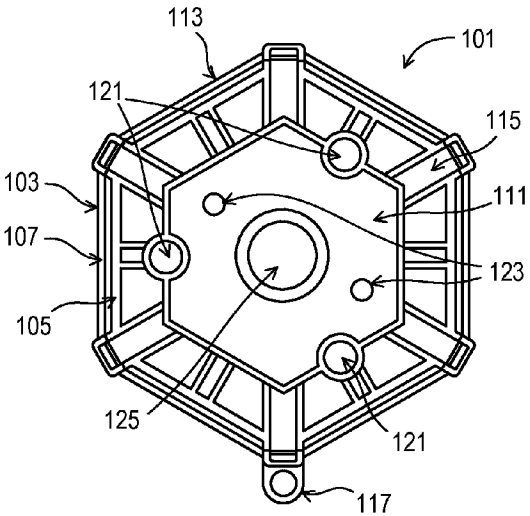
Figure 2F:
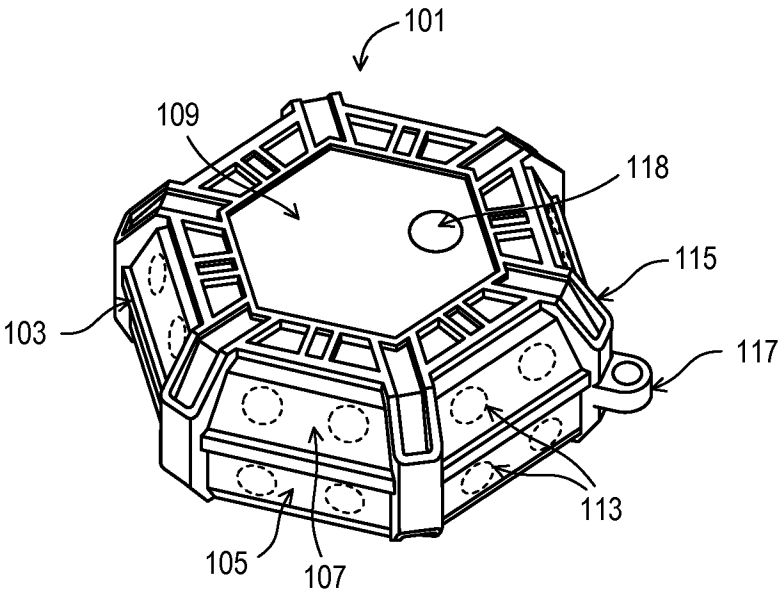
Figure 2E:
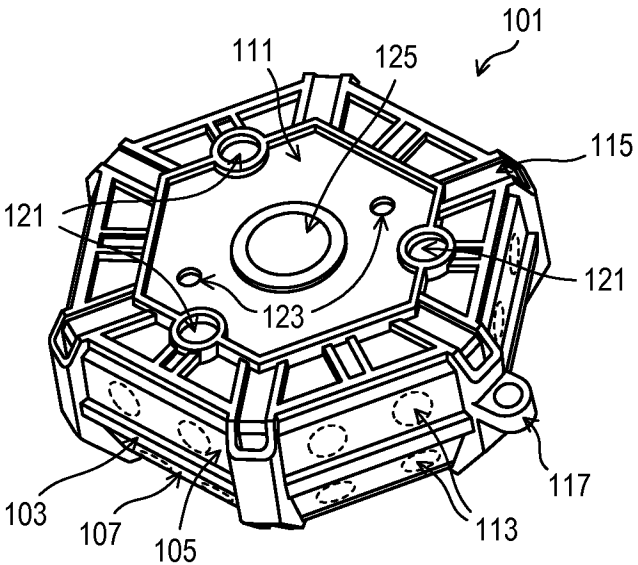

FIGS. 1E and 1F are a top and bottom perspective view of LED flare 101, respectively. Flare 101 may be produced in any number of different sizes that provide for a lightweight, durable and easy to use, store and carry flare 101. A configuration of 8 pairs of LEDs on the periphery 103 generates light patterns that are visible at multiple angles and from long distances to signal to people there is an emergency situation or other circumstances where a warning is appropriate. LED flare 101 with eight sides may have dimensions as follows: bottom diameter—4.528 inches (115 mm); top diameter—3.976 inches (101 mm); lower side panel width—0.730 inches (18.542 mm); upper side panel width—0.730 inches (37 mm) where the upper panel meets the lower panel and gradually narrowing to 0.5118 inches (13 mm) where the upper panel meets the top; lower side panel height—1.1024 inches (28 mm); upper side panel height—0.8661 inches (22 mm); and the angle between lower panel and upper panel—in the range of 15-30 degrees. These dimensions are provided as an example and other dimensions can be implemented as desired. It should be recognized that configurations with more LEDs or fewer LEDs could be implemented without altering the operation of the flare, including having more or fewer side panels than the eight described.

FIGS. 2A-2F show the same set of views as FIGS. 1A-1F for a second embodiment of LED flare 101. In this second embodiment, LED flare 101 is designed with six sides instead of the eight shown for the LED flare shown in FIGS. 1A-1F. LED flare 101 with six sides may have dimensions as follows: bottom diameter—3.975 inches (100.965 mm); top diameter—3.575 inches (90.8 mm); lower side panel width—0.730 inches (18.542 mm); upper side panel width—0.730 inches (18.542 mm) where the upper panel meets the lower panel and gradually narrowing to 0.530 inches (13.462 mm) where the upper panel meets the top; lower side panel height—0.875 inches (22.225 mm); upper side panel height—0.970 inches (24.638 mm); and the angle between lower panel and upper panel—in the range of 15-30 degrees. These dimensions are provided as an example and other dimensions can be implemented as desired. It should be understood that throughout the specification, reference to LED flare 101 shall include a flare with 6 or 8 sides, or in any number of other practical configurations.

Figure 3A:
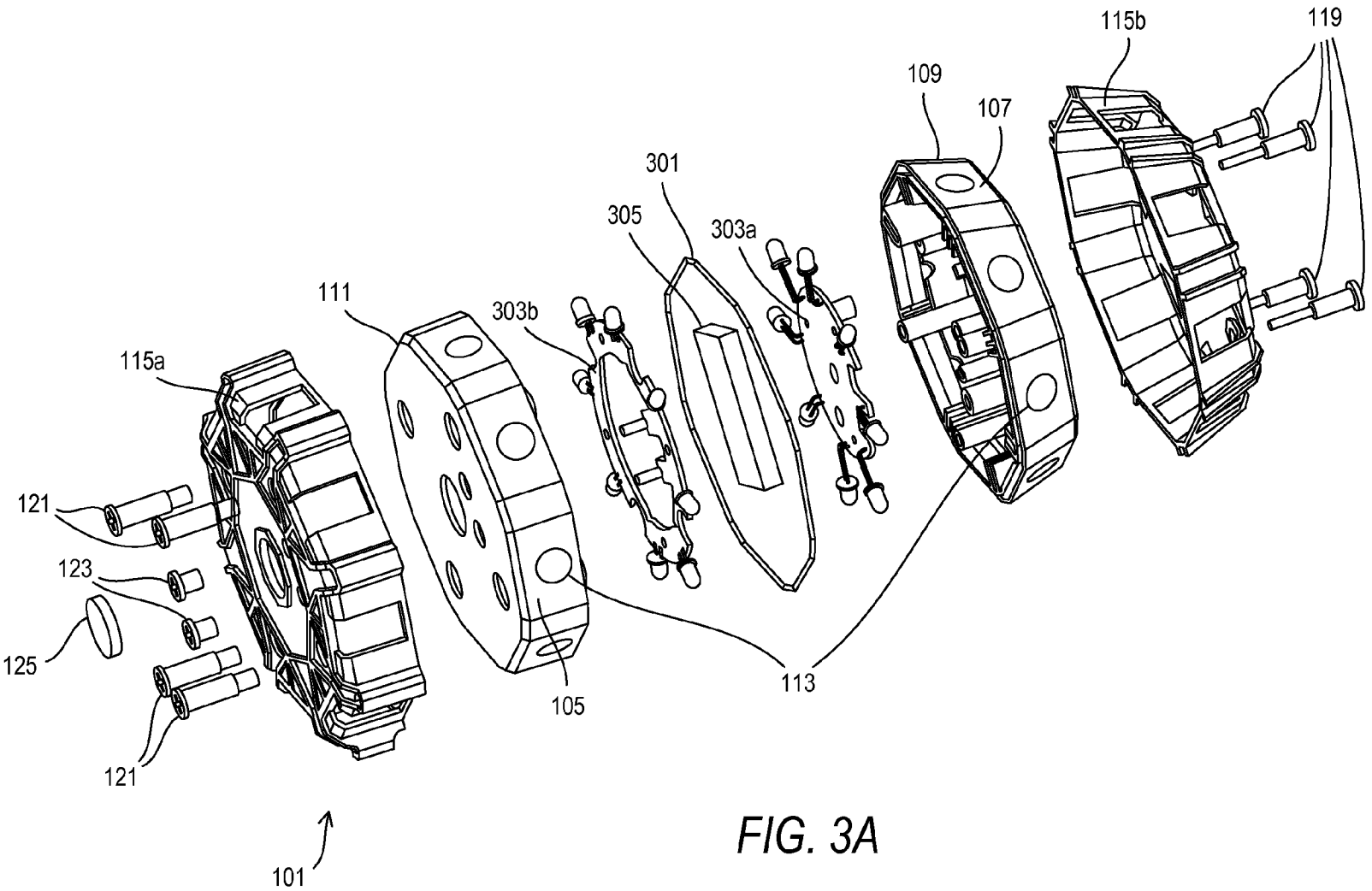
FIGS. 3A-D are perspective views of a LED flare including its component parts.

FIG. 3A is an exploded perspective view showing the individual components of LED flare 101 in relative position to each other. Top 109 and bottom 111 are formed of clear hard plastic and fit together to form a housing with a seal ring 201 fitted between them to resist penetration of water into the interior of the housing. Binding posts 119 and backs 121 hold the housing together. Fitted over the housing of flare 101 is a molded casing made of two parts, bottom case panel 115*a* and top case panel 115*b*. Both case panels are made of a rubber material that is semi-rigid to allow for easy installation over the housing of flare 101, while providing cushioning in the event that flare 101 is dropped or banged against a hard surface. The molded case also provides a texture over the housing of flare 101 for easy and comfortable grip.

Inside the housing of flare 101 are LED modules 303*a* and 303*b*. The modules are each configured in the shape of the housing with one or more LEDs positioned to align with windows 113 along periphery 103 of flare 101. LED modules 303*a* and 303*b* are positioned inside of the housing so that each upper panel 107 and a corresponding lower panel have an LED stacked one on top of the other. A rechargeable battery 305 is also enclosed in the housing and is in electrical connection with charging posts 123.

Figure 3D:
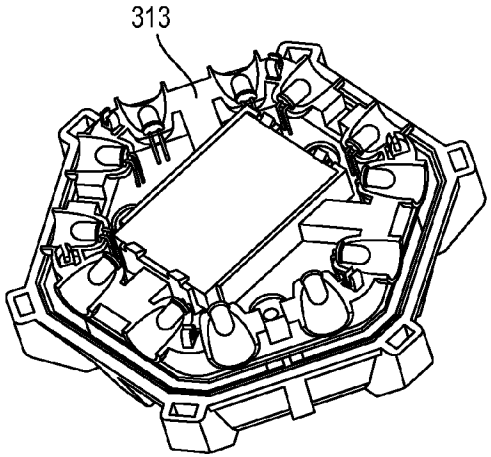
Figure 3C:
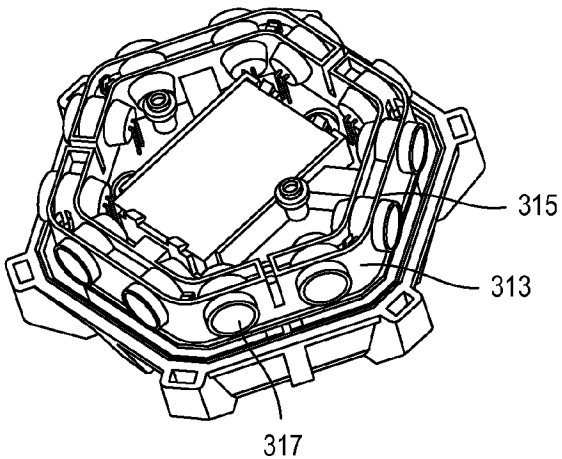
Figure 3B:
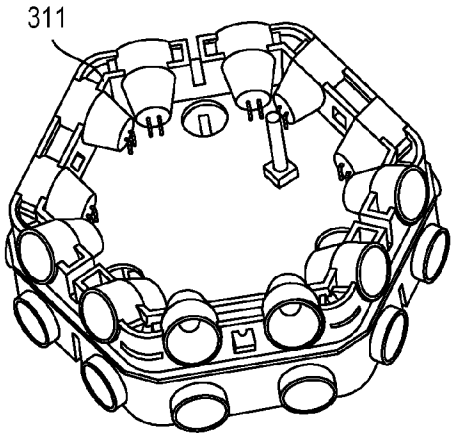

FIGS. 3B-3D show perspective views of a light focusing component 311 that may be used in LED flare 101. Light focusing component 311 includes a bottom section 313 and a matching top section 315 that fit together to form light channels 317 that surround each of the individual LEDs in LED modules 303. Bottom section 313 may fit between bottom 111 of flare 101 and light module 303*b* in FIG. 3A and top section 315 may fit between light module 303*b* and seal ring 301 to encase light module 303*b* and direct light from the LEDs in a radially outward direction through window 113. Similarly another light focusing component 311 would fit around light module 303*a* with bottom section 313 between light module 303*a* and seal ring 301, and top section 313 between light module 303*a* and top 109 of flare 101.

Figure 4:
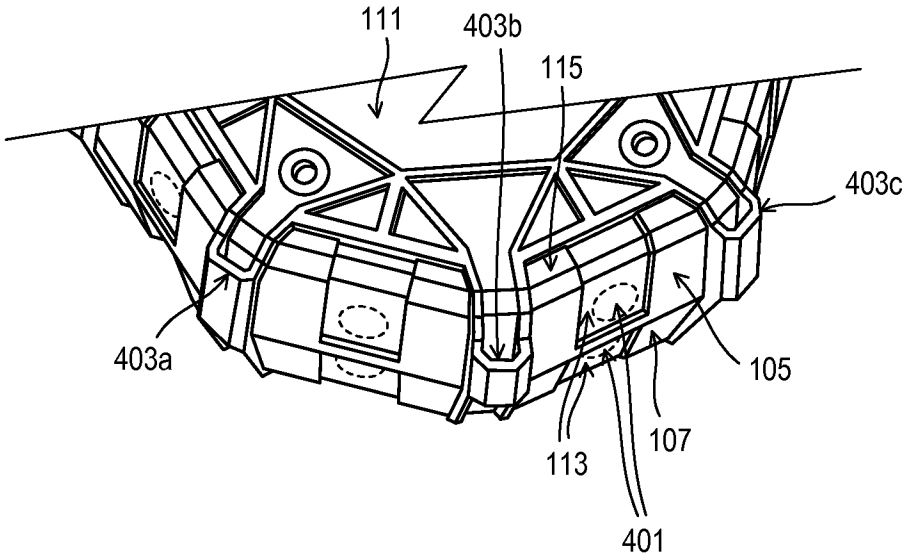
FIG. 4 is a perspective partial view of a LED flare with a window having a magnifying lens.

FIG. 4 is a close up perspective view of lower panel 105 and upper panel 107 on periphery 103 of flare 101 with flare 101 in a bottom facing up position. Windows 113 are centered within each panel. Individual LEDs are positioned within each window to emit light through window 113. A magnifying lens 401 may be integrated in window 113 to magnify the light emitted by the LED behind window 301. LED flare 101 may operate with or without magnifying lens 401 and with or without light focusing component 311. As can be seen in FIG. 4, a pair of LEDs stacked one on top of the other in lower panel 105 and upper panel 107. The stacking configuration enables a multitude of light patterns from the LEDs. Also shown in FIG. 4 are loops 403 formed in casing 115. In the event that flare 101 is dropped and lands on a loop 403, the rubber loop depresses providing a cushioning action to lessen the impact when flare 101 hits a surface.

Figure 5C:
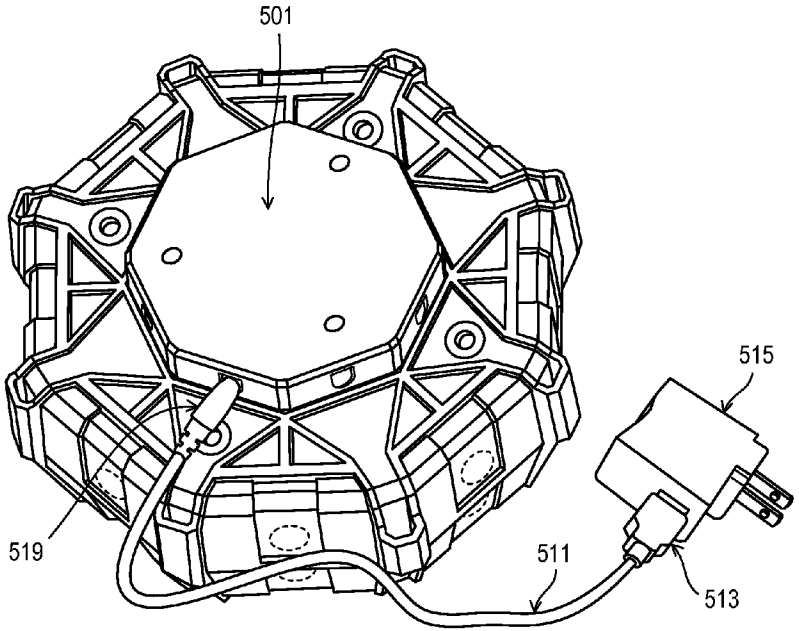
FIGS. 5A-5E are perspective views of a LED flare charger by itself and in charging position on a LED flare in a first embodiment.
Figure 5A:
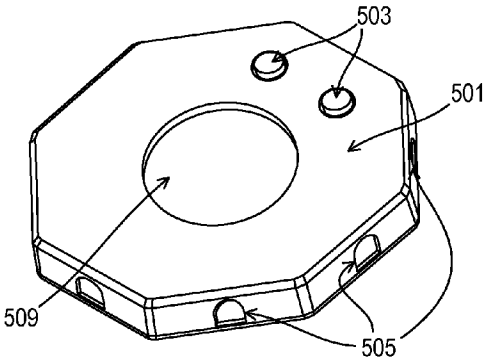
Figure 5B:
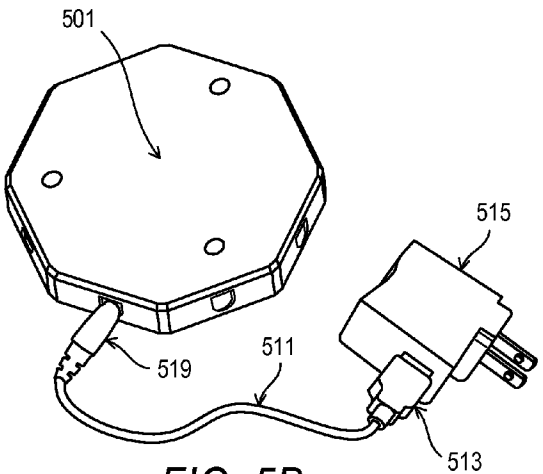

FIGS. 5A and 5B show perspective top and bottom views, respectively, of a charger 501. In FIG. 5A, a charger 501 is shown that attaches to flare 101 for charging battery 305. Charger 501 has charger contacts 503 that protrude slightly from the face of charger 501 to engage charging posts 123 on flare 101, which are slightly recessed into protective casing 115 on flare 101. Recessing the ends of charging posts 123 below the surface of casing 115 is preferred to avoid an inadvertent short circuit of battery 305 which is in electrical connection with charging posts 123.

It should be understood that while charger 501 may be any shape provided it houses charging contacts to align with charging posts 123, configuring charger 501 in a multi-sided shape with side panels 505, such as that pictured in FIGS. 5A-D with eight sides, permits charger 501 to fit within a raised frame 507 outlined in protective casing 115 on flare 101. Charger 501 also includes an attachment device 509 such as a magnet that is opposite in polarity to magnet 125 mounted inside of flare 101 so that they attract and hold charger 501 in place against flare 101.

FIG. 5C shows a bottom up perspective view of LED flare 101 with charger 501 attached to charger contacts 503. Charger 501 is used to charge battery 305 housed inside of LED flare 101 by making contact with charger contacts 503. Charger 501 has a removable power cord 511 that can be plugged into charger at connector 521 and that draws power either from an AC or DC. Attachment device 509 holds charger 503 in place against LED flare 101 during charging with charger contacts 503 aligned and in electrical connection with charging posts 123. Power cord 511 may include a USB type connector 513 that is adapted to be plugged directly into a USB port on a computer (not shown), other device with a standard USB port to provide power to charger 501, or AC adapter 515 as shown in FIG. 5C.

Figure 5E:
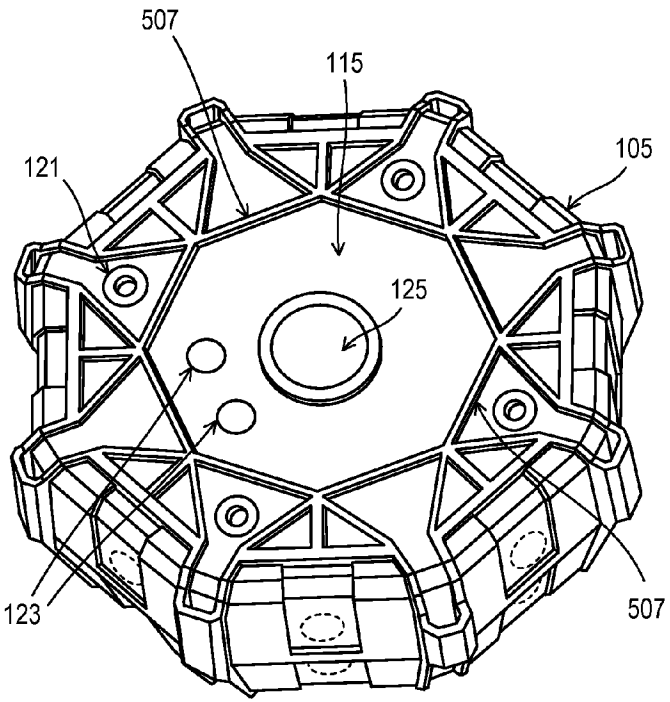
Figure 5D:
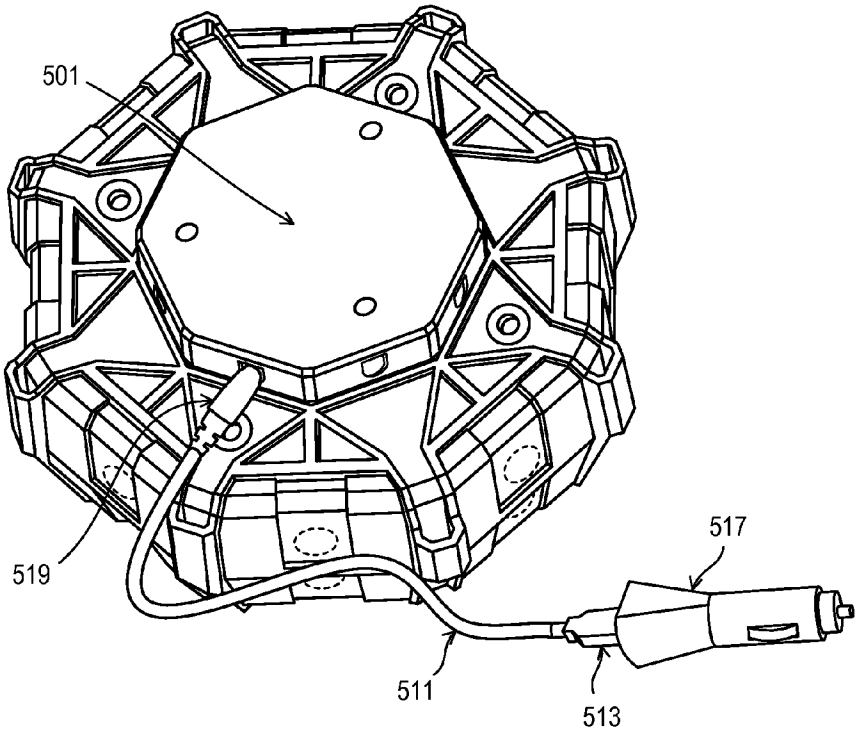

Alternatively, as shown in FIG. 5D, USB connector 513 may be connected to a DC adapter such as a standard vehicle lighter adapter 517 for drawing power from a car lighter. FIG. 5E shows a LED flare 101 with attachment device 125 and charging posts 123 that are configured to connect to charger 501 as shown in FIGS. 5A-5D.

Figure 6B:
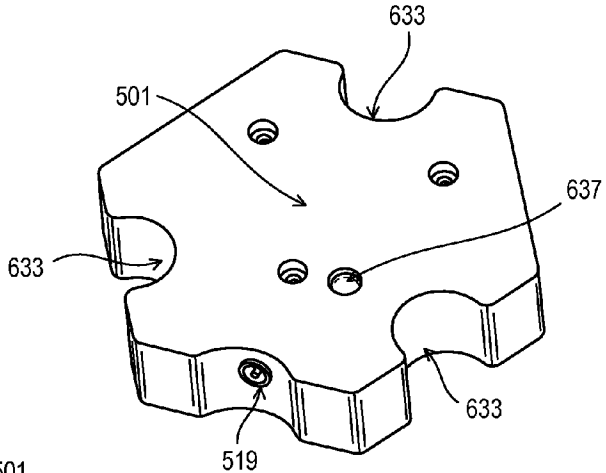
FIGS. 6A-6C show perspective views of a LED flare charger by itself and in charging position on a LED flare in a second embodiment.
Figure 6C:
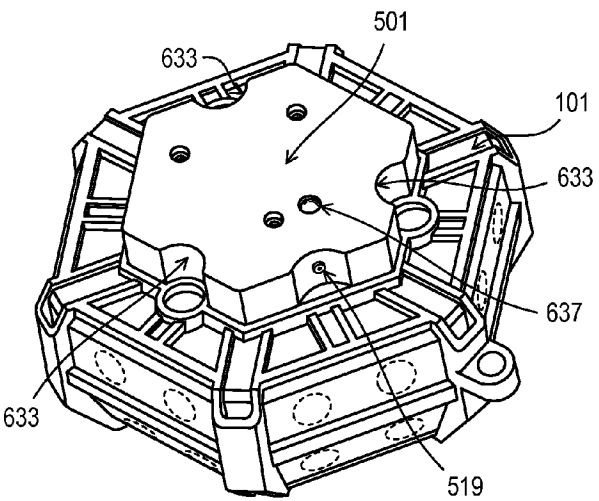
Figure 6A:
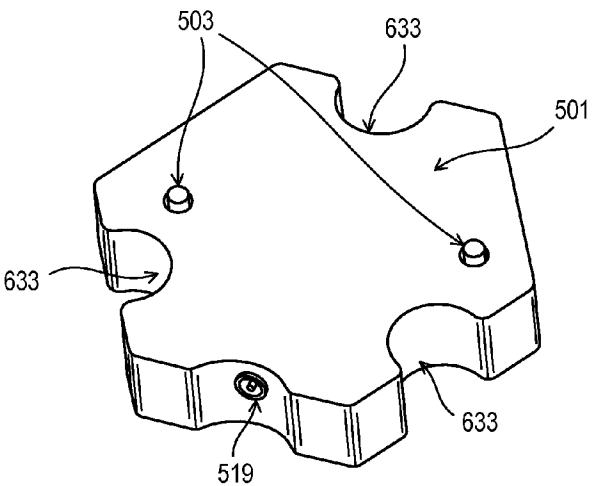

FIGS. 6A-C shows an alternative embodiment for a charger designed for use with a hexagonally shaped flare 101. The overall shape of charger 501 in this second embodiment is hexagonal with cutouts 633 and a connector 519 for the power cord (not shown). A power indicator light 637 indicates when charging is active. Charger 501 in this six sided embodiment operates in the same manner as eight sided charger 501 (described above) with charger contacts 503 protruding to make contact with charging posts 123 when charger 501 is in place against flare 101.

Figure 7:
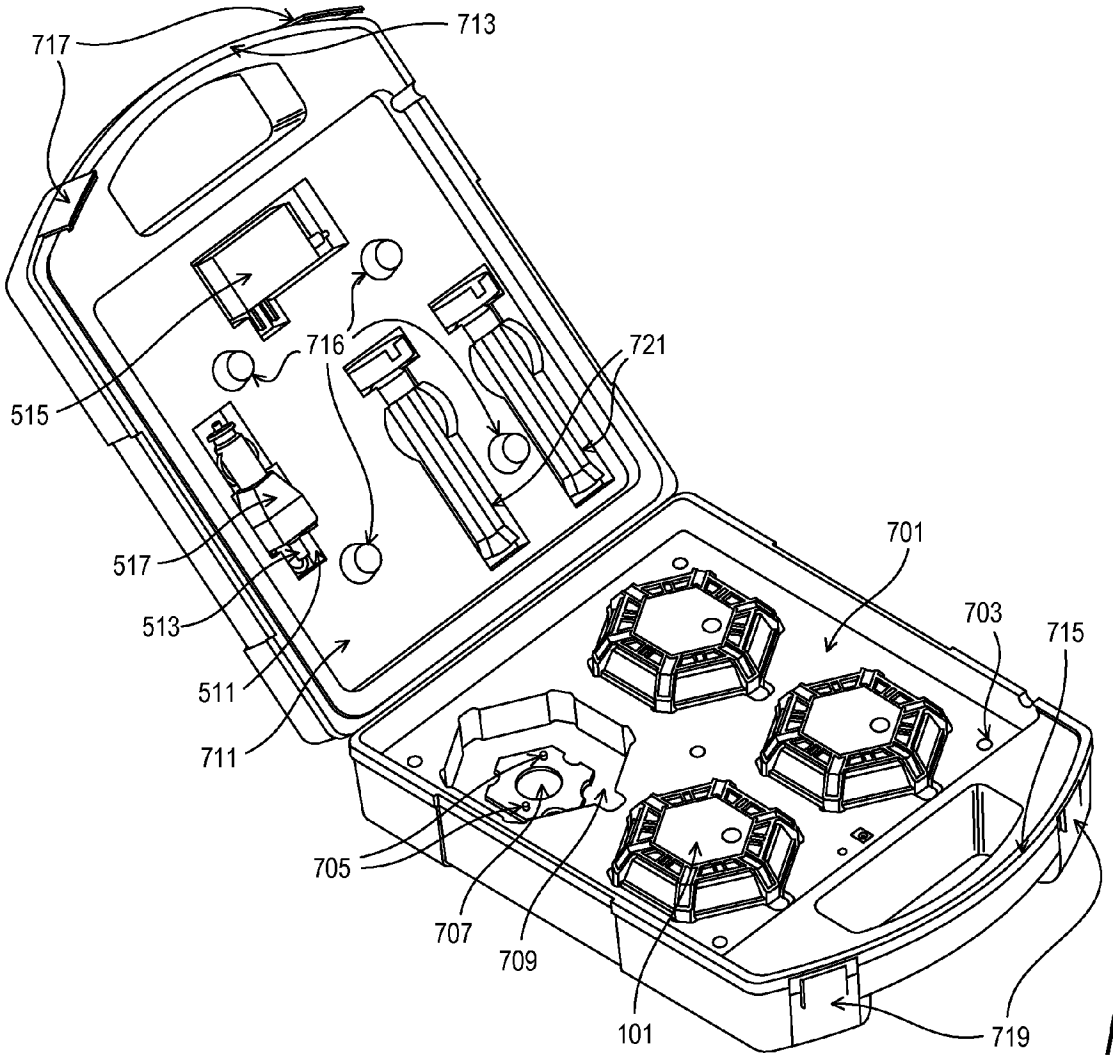
FIG. 7 is a perspective view of a carrying case kit with LED flares and accessories.

FIG. 7 is a perspective view of a carrying case base 701 capable of holding three LED flares 101 with integrated charging for each LED flare 101, and storage areas for accessories including power cord 511 with USB connector 513, AC adapter 515 and DC adapter 517. Carrying case base 701 is equipped with integrated charger contacts 705 to re-charge the batteries of LED flares 101 when placed in carrying case 701. Power cord 511 can be plugged into carrying case base 701 at carrying case base connector 703. The other end of power cord 515 is then plugged into a power source such as a USB port on a computer, an AC outlet using AC adapter 515 or DC adapter 517. A pair of case charger contacts 705 are integrated into carrying case base 701 and function in the same manner as charger contacts 503 on stand-alone charger 501, drawing power through power cord 511 that is connected into carrying case base 701 at case connector 703. An attachment device such as a magnet 707 holds flare 101 in place in a recessed slot 709 of carrying case base 701. Magnet 707 is particularly useful if charging is being performed with the case open and where there may be a chance of LED flare 101 being knocked out carrying case base 701, or to prevent rattling of LED flare 101 in carrying case base 701.

In the embodiment shown in FIG. 7, carrying case base 701 has a hinged cover 711 with a cover handle 713 that lines up with base handle 715 when cover 711 is closed. Protrusions 716 in cover 711 are appropriately shaped, and aligned with recessed slots 709 in carrying case base 701 to hold LED flares 101 and accessories such as flare stands 721 firmly in place when carrying case base 701 is in the closed position. Cover 711 may be locked in place on carrying case 701 by snapping down clasps 717 over protrusions 719 on carrying case base 701.

Carrying case base 701 and cover 711 may be manufactured using molded plastic which is lightweight, hollow and durable. Wires (not shown) may be run inside of the hollow area in base 701 between connector 703 and charger contacts 705.

Figure 8:
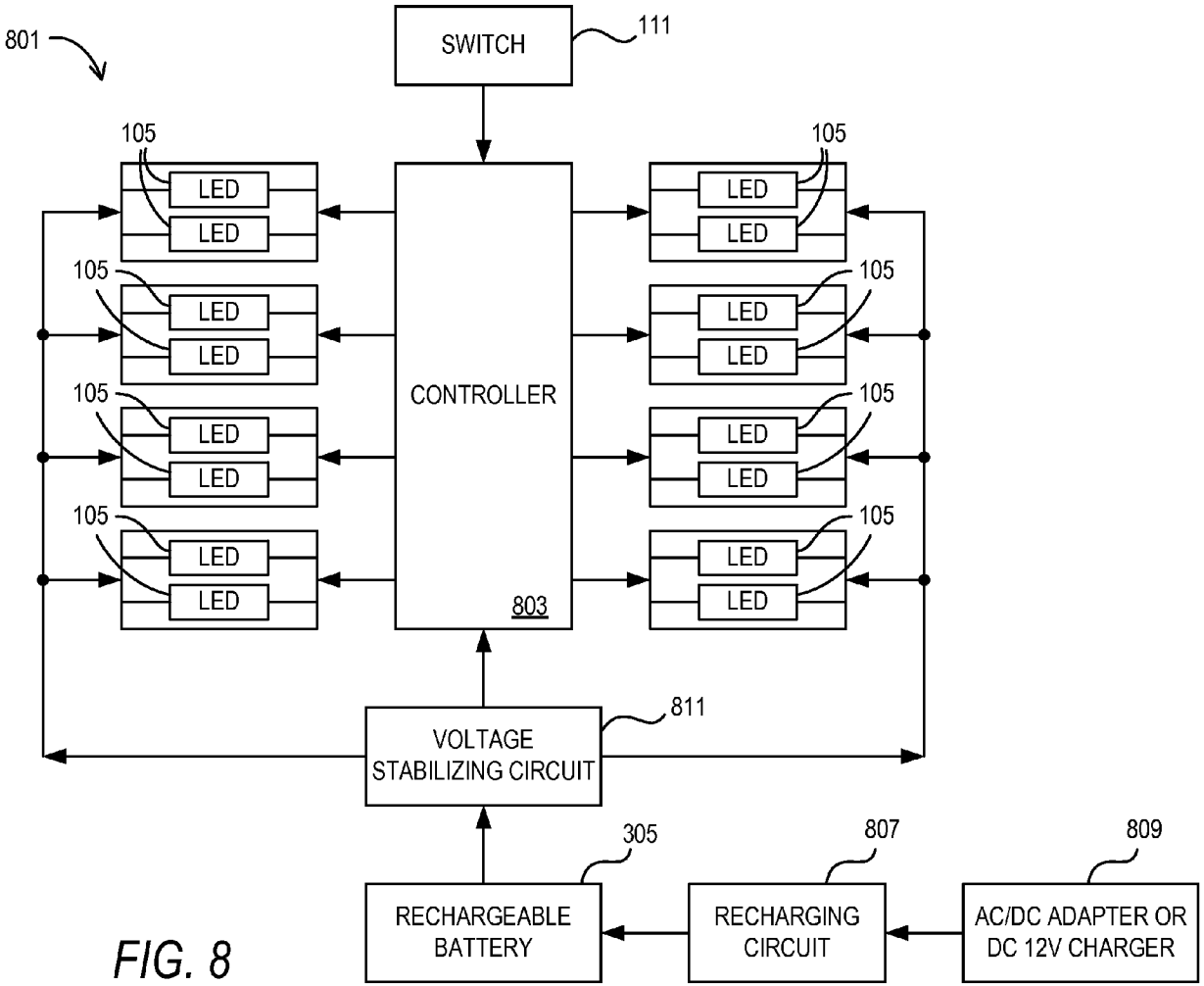
FIG. 8 shows a block diagram of an electrical circuit of the LED flare.

FIG. 8 is a block diagram of a circuit 801 mounted on one of the LED panels 303*a* or 303*b*, and enclosed within the housing of flare 101 made up of lower panel 105 and upper panel 107. Circuit 801 includes a controller 803 for controlling the operation of the multiple LEDs 105 housed within flare 101. Controller 803 is typically an integrated circuit and is programmed with one or more patterns for flashing and/or maintaining illumination of LEDs 105. Switch 111 is used to power on and power off flare 101. Switch 111 may also be used to cycle through any number of different light patterns of flare 101. For example, each LED 105 may be turned on for a fraction of a second in the sequential order as they are positioned along the length of flare 101. Alternatively, illumination may be set to alternate between LEDs 105 on either side of the housing of flare 101. It should be understood that the number of patterns possible is only limited by the number of LEDs 105 that are used in flare 101.

Controller 803 is powered by a battery 305, which in turn is recharged by a recharging circuit 807 connected to an adapter 809. Adapter 809 may be either an AC adapter 515 or a DC adapter 517 for supplying AC or DC to circuit 801 from a wall outlet, a cigarette lighter or another power source. A voltage stabilizing circuit 811 receives power supplied by battery 305 and delivers it directly to controller 803 and LEDs 105.

Operation of the invention will now be described with reference to FIGS. 1-8. Initially, flare 101 is powered off. Power is turned on by a user activating switch 111. Power is then delivered from battery 305 through voltage stabilizing circuit 811 to controller 803 and LEDs 105. Controller is programmed with a number of different lighting patterns through which the LEDs are cycled turning them on and off in accordance with the programmed patterns. Each pattern may be used to indicate a signal such as an emergency of a particular type, or just to maintain all of the lights in an illuminated state so that a parked vehicle is visible at night or in low light conditions. To cycle through the different illumination patterns, the user simply depresses switch 111. Alternatively two switches could be implemented with one delivering power and the second for changing the light pattern.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined with reference to the claims.

What is claimed is:

1. An electrically powered flare comprising:

a housing comprising:

a top;

a base; and a plurality of sides angled relative to each other configured around the periphery of the housing wherein each side includes a lower panel substantially perpendicular to the base and an upper panel angled between the lower panel and the top;

a plurality of LEDs aligned in windows positioned in each of the lower panels and in each of the upper panels, wherein light radially emitted from LEDs in the lower panels is directed at a first angle relative to the base and light radially emitted from LEDs in the upper panels is directed at a second angle relative to the base;

a switch on the housing for operating the flare;

a battery encased in the housing for powering the flare;

a circuit encased in the housing that is in electrical connection with the switch, the LEDs and the battery for delivering power and operational control from the battery to the LEDs upon activation by the switch; and contacts electrically connected to the battery and positioned on the outside of the housing for delivering a charge to the battery.

2. The apparatus of claim 1 wherein the circuit further comprises a controller programmed to provide at least one illumination pattern that is performed by the LEDs during operation of the flare.

3. The apparatus of claim 1 further comprising an attachment device for holding an external charger in place against the contacts during a charging operation.

4. The apparatus of claim 3 wherein the attachment device is a magnet.

5. The apparatus of claim 1 further comprising a protective casing that fits over an outer surface of the housing with a plurality of openings aligned with the positions of the LEDs.

6. The apparatus of claim 5 wherein the contacts are recessed in the protective casing on the housing.

7. The apparatus of claim 5 wherein the protective casing further comprises loops positioned at a junction of each pair of lower panels along the outer surface of the sides of the housing wherein any two adjacent loops form opposed feet on which the flare may be stably positioned.

8. The apparatus of claim 1 wherein the housing further comprises a plurality of LED windows that are integrated in the lower panels and the upper panels of the housing and aligned with the positions of the LEDs, the windows being generally convex in shape to magnify the intensity of the light emitted from the LEDs.

9. The apparatus of claim 1 further comprising a light focusing component to channel light from at least one of the LEDs in a radially outward direction.

10. The apparatus of claim 1 wherein for each lower panel and each upper panel, at least two LEDs are positioned therein.

11. The apparatus of claim 10 wherein the at least two LEDs are either stacked or adjacent to each other.

12. The apparatus of claim 1 wherein the contacts are recessed in a protective casing on the housing.

13. The apparatus of claim 12 wherein the protective casing further comprises loops positioned at a junction of each pair of lower panels along the outer surface of the sides of the housing wherein any two adjacent loops form opposed feet on which the flare may be stably positioned.

14. A system for providing a warning in low light conditions comprising:

at least one LED flare including:

a housing comprising:

a top;

a base; and a plurality of sides angled relative to each other configured around the periphery of the housing wherein each side includes a lower panel substantially perpendicular to the base and an upper panel angled between the lower panel and the top;

a plurality of LEDs aligned in windows positioned in each of the lower panels and in each of the upper panels, wherein light radially emitted from LEDs in the lower panels is directed at a first angle relative to the base and light radially emitted from LEDs in the upper panels is directed at a second angle relative to the base;

a switch on the housing for operating the flare;

a battery encased in the housing for powering the flare;

a circuit encased in the housing that is in electrical connection with the switch, the LEDs and the battery for delivering power and operational control from the battery to the LEDs upon activation by the switch;

contacts electrically connected to the battery and positioned on the outside of the housing for delivering a charge to the battery; and a carrying case including:

a first side with at least one slot for holding the at least one LED flare wherein the first side further comprises integrated charging contacts for electrically contacting the contacts on the LED flare; and a second side that fits over the first side.

15. The system of claim 14 wherein the carrying case further comprises integrated charging contacts for electrically contacting the contacts on the LED flare when the LED flare is positioned in the carrying case.

16. The apparatus of claim 15 wherein the flare further comprises an attachment device for holding the flare in electrical contact with the integrated charging contacts in the carrying case.

17. The apparatus of claim 16 wherein the attachment device is a magnet.

18. The system of claim 14 wherein the carrying case further comprises a recessed area for storing a charger adapter and cord.

19. The apparatus of claim 14 wherein the circuit further comprises a controller programmed to provide at least one illumination pattern that is performed by the LEDs during operation of the flare.

20. The apparatus of claim 14 further comprising a protective casing that fits over an outer surface of the housing with a plurality of openings aligned with the positions of the LEDs.

21. The apparatus of claim 14 wherein the housing further comprises a plurality of LED windows that are integrated in the lower panels and the upper panels of the housing and aligned with the position of the LEDs, the windows being generally convex in shape to magnify the intensity of the light emitted from the LEDs.

22. The apparatus of claim 14 wherein for each lower panel and each upper panel, at least two LEDs are positioned therein.

23. The apparatus of claim 22 wherein the at least two LEDs are either stacked or adjacent to each other.

24. The apparatus of claim 14 further comprising a light focusing component to channel light from at least one of the LEDs in a radially outward direction.

* * * * *